US005190447A

United States Patent [19]

Schneider

[11] Patent Number: 5,190,447

[45] Date of Patent: Mar. 2, 1993

[54] HYDRAULIC PUMP WITH INTEGRAL ELECTRIC MOTOR

[75] Inventor: William E. Schneider, Annapolis, Md.

[73] Assignee: The United States of America as represented by the Secretary of the Navy, Washington, D.C.

[21] Appl. No.: 855,827

[22] Filed: Mar. 23, 1992

[51] Int. Cl.[5] ..... F04B 27/08; F04B 35/04

[52] U.S. Cl. ..... 417/356; 417/270

[58] Field of Search ..... 417/356, 355, 269, 270, 417/271, 272, 273

[56] References Cited

U.S. PATENT DOCUMENTS

| | | | |
|---|---|---|---|
| 1,926,444 | 9/1933 | Jones | 230/117 |
| 2,250,947 | 7/1941 | Carpenter | 417/356 |
| 2,468,948 | 5/1949 | Smith | 230/139 |
| 2,485,753 | 10/1949 | Lefler et al. | 417/271 |
| 2,711,286 | 6/1955 | McAdam | 417/356 |
| 4,831,297 | 5/1989 | Taylor et al. | 310/87 |
| 4,850,812 | 7/1989 | Voight | 417/271 |

FOREIGN PATENT DOCUMENTS

| | | | |
|---|---|---|---|
| 0111185 | 8/1925 | Fed. Rep. of Germany | 417/355 |
| 62-7993 | 1/1987 | Japan . | |

*Primary Examiner*—Richard A. Bertsch
*Assistant Examiner*—Alfred Basichas
*Attorney, Agent, or Firm*—Howard Kaiser

[57] ABSTRACT

A pumping mechanism featuring integration of a fixed-displacement radial piston pump within an electric drive motor and cooperative operation of a radially inwardly facing piston-actuating cam with a pair of opposing axially inwardly facing spool-valve actuating cams. The piston-actuating cam is effectively the inner surface of the rotating motor rotor, the pistons extending radially from a fixed central body. Consequent benefits of the integrated configuration are greater quietness, compactness, efficiency and corrosion resistance. The external motor unit provides protection, there is a damping effect, and there are fewer parts which are subject to damage or malfunction. Further reductions in noise and leakage are gained by synchronized operation, in terms of fluid pumping, of the spool-valve actuating cams and the piston-actuating cam. The piston elements can be distributed so as to foster balanced loadings, and the pump flow rate can be controlled by varying the motor's rotational speed, thus advantageously combining the hydraulic pressure balance which is characteristic of a fixed-displacement pump with the variable delivery of a variable-displacement pump.

5 Claims, 4 Drawing Sheets

HYDRAULIC PUMP WITH INTEGRAL ELECTRIC MOTOR

The invention described herein may be manufactured and used by or for the Government of the United States of America for governmental purposes without the payment of any royalties thereon or therefor.

BACKGROUND OF THE INVENTION

The present invention relates to radial-piston pumps, more particularly to radial-piston fixed-stroke pumps which are integrated within electric drive motors.

Integration of an electric drive motor and pumping mechanism is known in the art. Jones U.S. Pat. No. 1,926,444, incorporated herein by reference, discloses a compressor or pump combined with a motor. Jones recognizes as early as 1933 that "a structure wherein certain motor parts and those constituting the compressor, pump or the like, interact and are common to each mechanism constituting the novel unit" serves to further "compactness, durability, simplicity and maintain the cost of production and upkeep at a minimum." Voight U.S. Pat. No. 4,850,812, integrated herein by reference, also recognizes the benefit of "utiliz(ing) an integrated design in which the pump elements and motor housing are co-extensive with one another" for applications involving limited available space, such as in aircraft.

Other references of note which disclose integration of a motor with a pump or pump-analogue mechanism, incorporated herein by reference, are Smith U.S. Pat. No. 2,468,948; Taylor et al. U.S. Pat. No. 4,831,297; and, Matsushima Japanese Patent 62-7993. Smith discloses a motor-compressor design which is especially useful for refrigerator applications. Taylor et al. teach integration of a motor with a propulsion propeller for marine applications; this submersible design requiring no external shafting or gears is advantageous not only in terms of compactness and noise reduction but also in terms of decreased susceptibility to corrosion and electrical conductivity by ocean salt water. Matsushima discloses a rotary compressor integrated in the rotor of an electric motor; the compressor vane slides on the inner peripheral surface of an eccentric hole in the rotor, and the discharge passage is positioned in the rotor, in furtherance of reduction of noise and vibration, so as to counteract the imbalance attributable to the eccentric hole.

Noise, compactness, suitability for use in certain deleterious fluid environments and overall efficiency are thus seen as aspects of hydraulic systems and the like which have drawn the attention of designers for various applications. Many industrial applications are required to meet Occupational Safety and Health Administration (OSHA) environmental noise standards. Marine, aircraft and other applications have significant space considerations. Many applications of hydraulic systems involve operation in corrosive environments, such as ocean water, where corrosive fluids are pumped; typically the pump/motor combination is totally immersed within the fluid being pumped.

OBJECTS OF THE INVENTION

In view of the foregoing, it is an object of the present invention to provide a quieter hydraulic pump.

It is a further object of this invention to provide a more compact hydraulic pump.

Another object of this invention is to provide a hydraulic pump which is better suited for operating in the ocean or other corrosive or high pressure environment.

A further object is to provide a more efficient hydraulic pump.

SUMMARY OF THE INVENTION

The present invention provides an integrated pumping mechanism, comprising an electric motor and a pump. The electric motor has an external stator and an internal rotor. The pump has a fixed central member, a plurality of coplanar pistons which are coupled with the fixed central member, and a plurality of parallel spool valves which are coupled with the fixed central member and are perpendicular to the pistons and parallel to the axis. The rotor has a geometric axis of rotation, an aperture which defines a radially inwardly facing cam surface which surrounds the axis, an inlet cam plate which has an axially inwardly facing inlet cam surface, and an outlet cam plate which has an axially inwardly facing outlet cam surface which is opposed the axially inwardly facing inlet cam surface.

The fixed central member is concentric with the axis and has an inlet port and an outlet port. Each piston has a radially inner end and a radially outer end. Each piston radially outwardly extends from the fixed member and slidably and reciprocatingly engages the radially inwardly facing cam surface of the aperture of the rotor at the radially outer end of the piston.

Each spool valve has an inlet end and an outlet end, is located adjacent to the radially inner end of one piston, and communicates with the inlet port and the outlet port. Each spool valve slidably and reciprocatingly engages the axially inwardly facing inlet cam surface at the inlet end of the spool valve and slidably and reciprocatingly engages the axially inwardly facing outlet cam surface at the outlet end of the spool valve. The axially inwardly facing inlet cam surface and the axially inwardly facing outlet cam surface each have sinuosity with respect to the geometric plane defined by the pistons. The sinuosity of the axially inwardly facing inlet cam surface is complementary with respect to the sinuosity of the axially inwardly facing outlet cam surface. The engagements of the pistons with the radially inwardly facing cam surface of the aperture of the rotor coordinate with the engagements of the spool valves with the axially inwardly facing inlet cam surface and the axially inwardly facing outlet cam surface.

The present invention features integration of a fixed-displacement radial piston pump within an electric drive motor. The piston-actuating cam is the inner surface of the rotating motor rotor, or, for some embodiments, the inner surface of a ring which is internally and concentrically coupled with the rotating motor rotor. The pistons extend radially from a fixed central body. There are fewer parts, e.g., no shafts or shaft seals.

The resultant benefits of the configurational integration according to the present invention in terms of quietness, compactness, corrosion resistance and efficiency are manifest. Integrating the pump in the motor, for many embodiments a large mass motor, not only can have a significant damping effect but can provide protection from external forces. Fewer parts in the unit also means less noise and less vulnerability to the environmental elements, as well as less elements which can malfunction or become defective.

For some embodiments of this invention the piston elements are distributed so as to foster balanced loadings on the piston-actuating cam/electric motor bearings and avoid hydraulic pressure imbalance across the rotor which can reduce maximum speed and pressure. Some embodiments utilize a variable speed electric motor for controlling pump flow rate by controlling motor speed of rotation. Hence the present invention advantageously lends itself to combining the hydraulic pressure balance which is characteristic of a fixed-displacement pump with the variable delivery of a variable-displacement pump.

Notably, the present invention additionally features spool valves in sliding and reciprocating engagement with a pair of cooperating spool-valve actuating cams. The spool-valve actuating cams in turn coordinate with the piston-actuating cam, further reducing noise and reducing leakage, e.g., over slotted portal plates.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
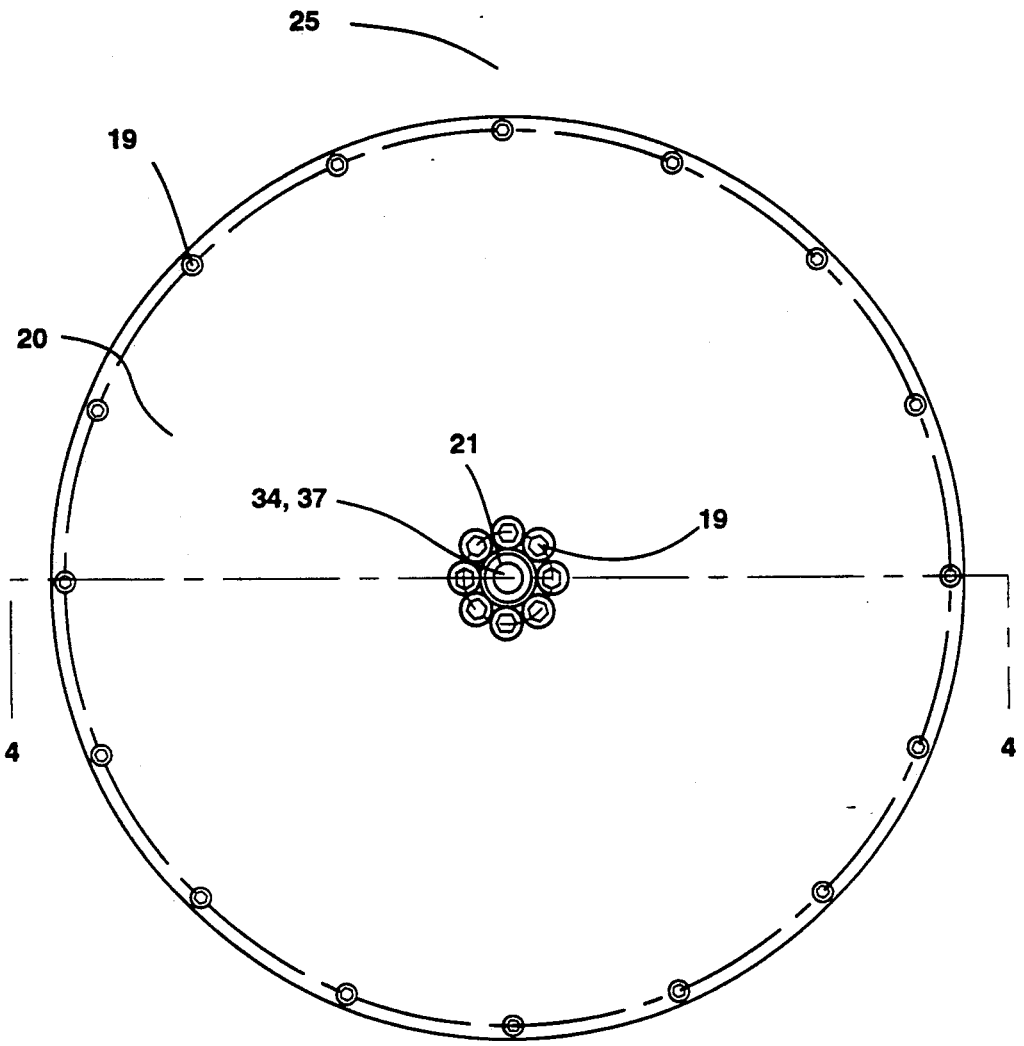
FIG. 1 is a diagrammatic plan view of the integrated pumping mechanism in accordance with the present invention.
Figure 2:
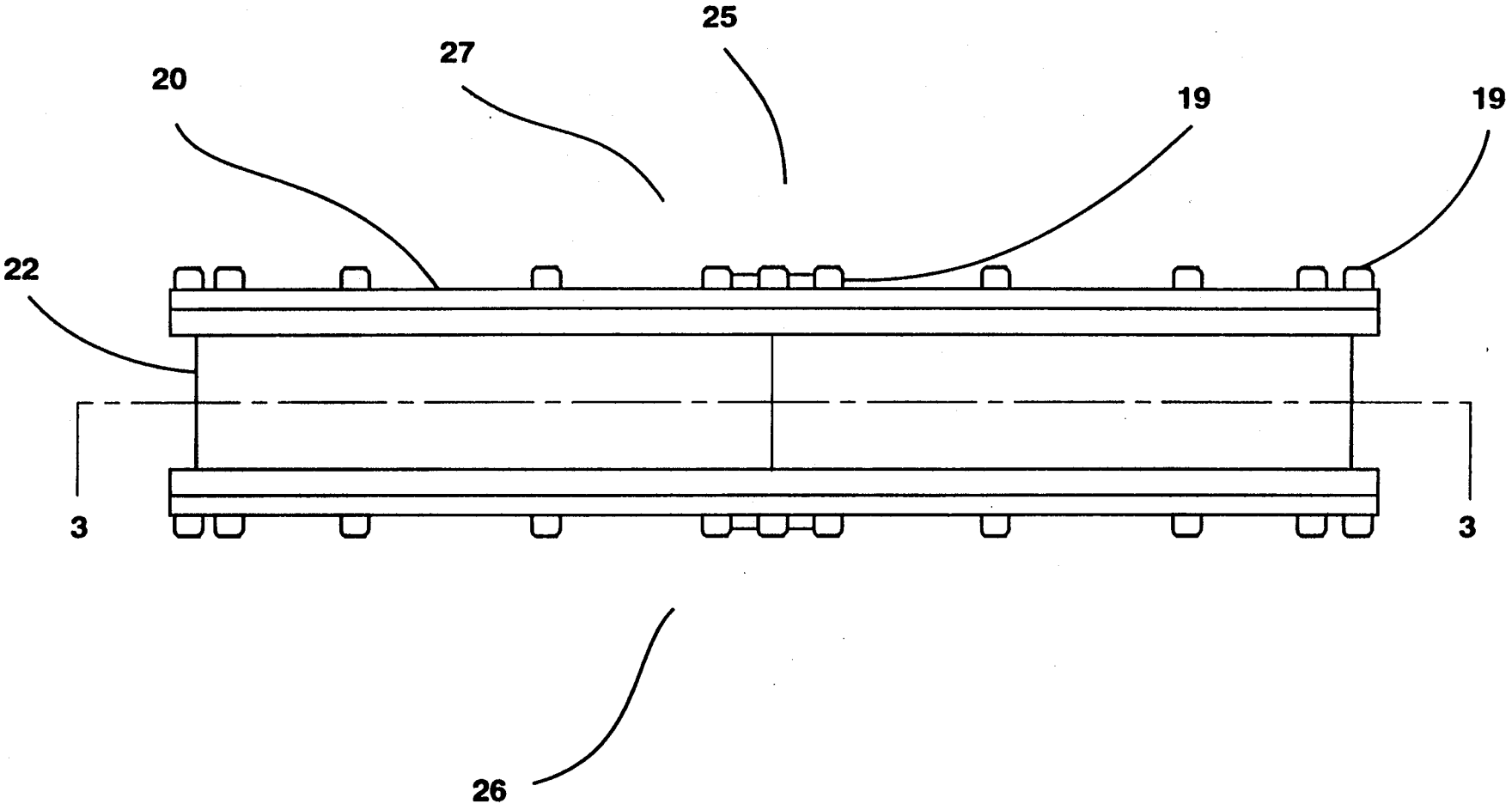
FIG. 2 is a diagrammatic elevational view of the integrated pumping mechanism in accordance with the present invention.

Referring now to FIG. 1 and FIG. 2, disc-shaped housing for integrated pumping mechanism 25 in accordance with the present invention includes a pair of circular side plates 20 and circularly circumferential motor armature frame 22. As more clearly shown in FIG. 4, the housing assembly of plates 20 and frame 22 along with pump body 21 is secured by bolts 19. The centrally located port in FIG. 1 is viewed as inlet port 34 from inlet side 26 of integrated pumping mechanism 25 and as outlet port 37 from the outlet side 27 of integrated pumping mechanism 25.

Figure 3:
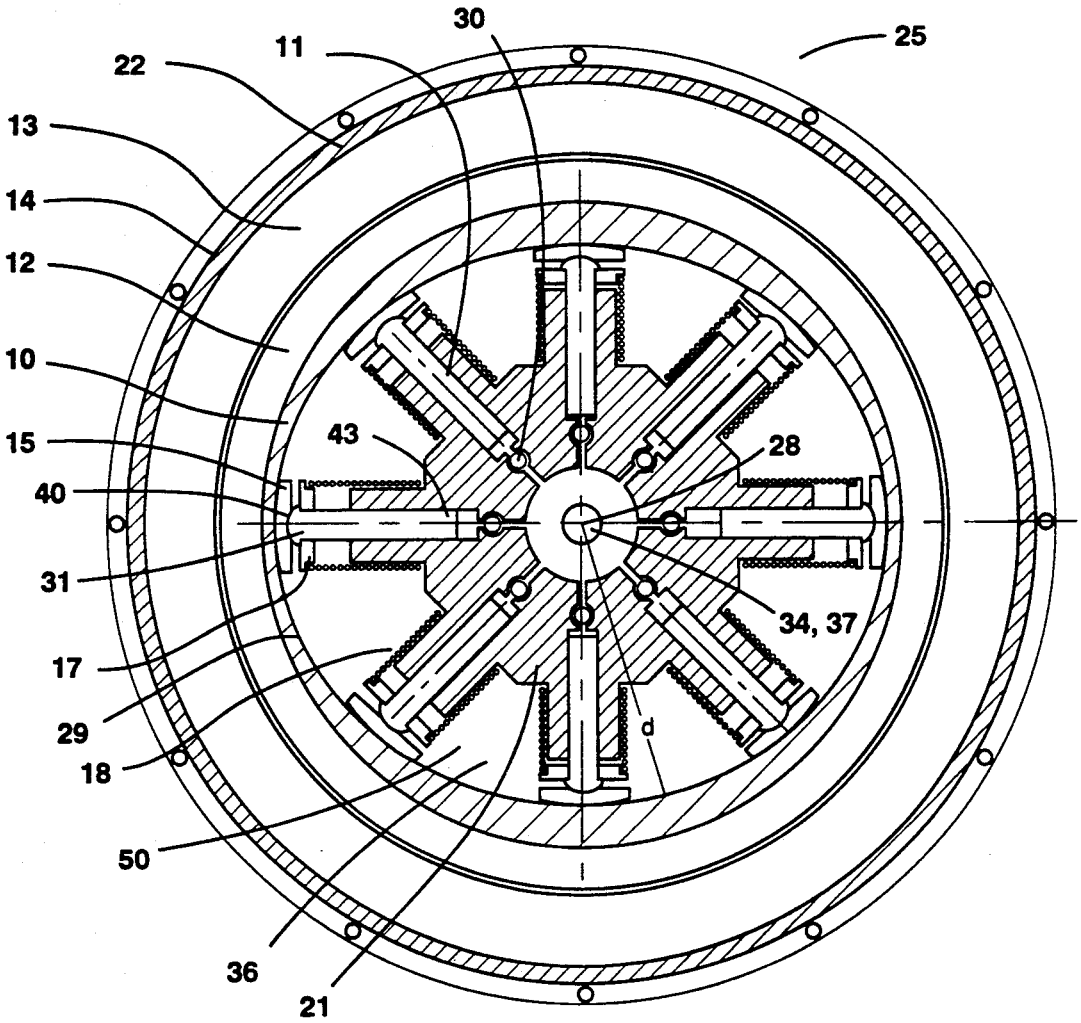
FIG. 3 is a view as in FIG. 1 and in section as taken along the line 3—3 in FIG. 2.
Figure 4:
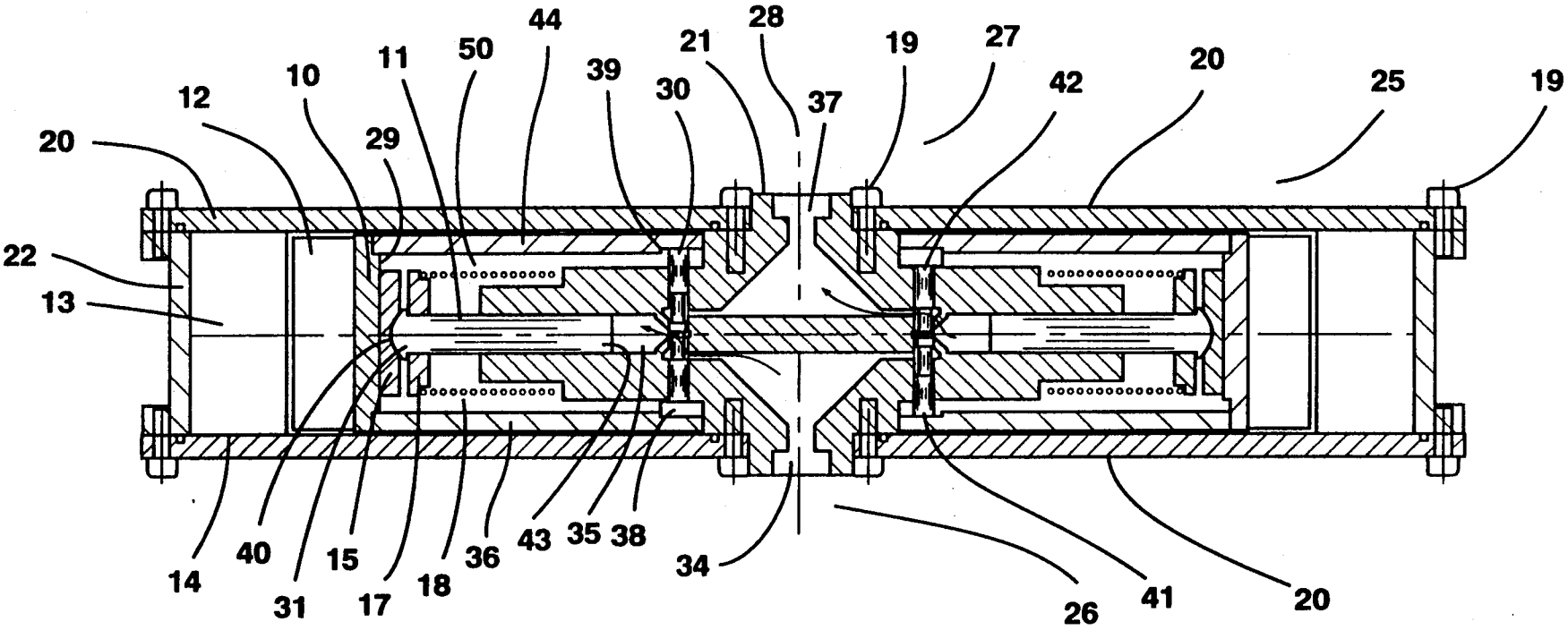
FIG. 4 is a view as in FIG. 2 and in section as taken along the line 4—4 in FIG. 1.

With reference to FIG. 3 and FIG. 4, constant-flow cam ring 10 is used to induce reciprocating motion to pistons 11. Pistons 11 are located within cam ring 10 and are radial to center of rotation 28 of cam ring 10. Inner cam surface 29 of cam ring 10 in accordance with this invention is eccentric as being noncircular and/or nonconcentric with respect to center of rotation 28. In this example cam ring 10 is elliptical and concentric with center of rotation 28, and pistons 11 are evenly distributed about center of rotation 28, in furtherance of balanced loadings. Integrated pumping mechanism 25 in accordance with the present invention thus beneficially combines the force-balancing characteristics of the balanced cam radial piston pump with the compactness of the integrated ring-type brushless DC motor.

Electric motor 14 has circular motor rotor 12, circular motor armature 13 and circular motor armature frame 22. Rotation of cam ring 10 simultaneously with motor rotor 12 is accomplished by an open bore permanent magnet brushless DC torque motor 14 which operates with all components exposed to the fluid within cam ring 10. This type of motor 14 can operate at relatively low speeds and high output shaft torques, thus offering greater efficiency and reduced noise from pump operation. Variation of rotational speed of cam ring 10 is accomplished by variation of rotational speed of motor rotor 12.

Motor armature 13 is an epoxy encapsulated stator unit which includes a laminated stator core and multiphased motor windings. Motor armature frame 22 acts as a support and housing for motor armature 13. Motor rotor 12 has a banded permanent magnet section which is attached to a magnetic stainless steel backing ring. Motor rotor 12 is keyed and transmits torque directly to cam ring 10.

Pump side plates 20 rigidly support and maintain motor armature frame 22 and motor armature 13 stationary (non-rotating) and align them to stationary (non-rotating) pump body 21. Pump body 21 also acts as bearing surfaces for valve cam plates 36 and 44. Valve cam plates 36 and 44 axially and radially align rotating motor rotor 12 and cam ring 10. The magnetic forces present in motor armature 13, when motor 14 is operating, act to center motor rotor 12 in the bore of motor armature 13, which is concentric with pump body 21 and center of rotation 28. This action reduces the forces applied to the bearing surfaces of pump side plates 20.

Pump body 21 has pumping pistons 11 in a radial orientation which coincides with center of rotation 28 for cam ring 10 and motor rotor 12. Sliding shoe 15, situated between inner cam surface 29 of cam ring 10 and radially outer end 31 of each piston 11, slidably engages inner cam surface 29. Sliding shoe 15 has spherical socket 40 for moveably engaging spherical outer end 31 and thus permitting angular movement between piston 11 and shoe 15 as shoe 15 slides around eccentric inner cam surface 29 of cam ring 10. As motor rotor 12 and cam ring 10 rotate about center of rotation 28 distance d from center of rotation 28 to inner cam surface 29 changes. This motion is transmitted to pumping pistons 11 via sliding shoes 15, causing pumping pistons 11 to reciprocate.

Piston cap 17 is fitted to spherical outer end 31 of each piston 11. Compression spring 18, situated between each piston cap 17 and pump body 21, serves to push piston 11 radially outward and hold piston 11 and shoe 15 against inner cam surface 29 of cam ring 10.

Piston 11 stroke displacement is determined by the configurational eccentricity of inner surface 29 of cam ring 10 in terms of the size (cross-sectional area) and shape of inner cam surface 29 relative to center of rotation 28. The actual piston 11 stroke displacement for some embodiments of this invention is preferably a varied functional relation among pistons 11 which seeks to minimize noise caused by rapid accelerations and decelerations of the pumping components and pumped fluid. For most embodiments cam ring 10 is shaped to provide one or more strokes per revolution, of motor rotor 12. With more than one stroke per revolution, the forces transmitted to cam ring 10 and motor rotor 12 can be balanced in order to reduce the loads on the pump side plate 20 bearing surfaces.

The configuration of inner surface 29 of cam ring 10 determines the length of stroke, velocity, rate of acceleration and rate of deceleration for pistons 11 as they proceed through a cycle of cam ring 10 rotation. The configuration of inner surface 29 also determines, along with the number of pistons 11 and the rotational speed of cam ring 10, the volume of fluid being pumped.

Spool valve 30 is located radially inward of and adjacent to inner end 43 of each piston 11. As piston 11 moves outward from center of rotation 28, fluid is drawn into inlet port 34, through the corresponding spool valve 30, and into the corresponding pumping chamber 35 which is formed by piston 11 and pump body 21. After piston 11 reaches its maximum radially outward position it reverses direction and forces the fluid out of pumping chamber 35, through spool valve 30, and out of discharge port 37.

Inlet cam lobe 38 and outlet cam lobe 39 are integrated with, respectively, inlet valve cam plate 36 and outlet valve cam plate 44. Valve cam plates 36 and 44 are each coupled with cam ring 10. Motor rotor 12, cam ring 10, inlet cam plates 36 and 44, and cam lobes 38 and 39 rotate simultaneously. Inlet cam lobe 38 slidably engages spool valves 30 at inlet end 41 of each spool valve 30 and outlet cam lobe 39 at outlet end 42 of each spool valve 30; cam lobes 38 and 39 are selectively shaped and thus "timed" to coordinate, positionally and in terms of fluid being pumped into and out of pumping chambers 35, the axial movements of spool valves 30 to the radial movements of pumping pistons 11. For most embodiments of this invention the selective combination of a specifically configured piston 11-actuating inner cam surface 29 with specifically configured spool valve-actuating cam lobes 38 and 39, thereby precisely timing the positions of pistons 11 in relation to the positions of spool valves 30, serves to quiet pumping operation.

Annular cavities 50 can be filled with the fluid being pumped or with a special lubricating fluid. For embodiments wherein a special lubricating fluid is used, reciprocating seals are preferably installed between pistons 11 and pump body 21 in order to maintain separation of the pumped fluid and the lubricating fluid, thus permitting a corrosive, non-lubricating fluid to be pumped. Also, seals are preferably added between pump body 21 and side plates 20, in furtherance of permitting pump operation while submerged in a corrosive fluid such as seawater.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. An integrated pumping mechanism, comprising:

an electric motor having an external stator and an internal rotor; and

Said rotor having a geometric axis of rotation, an aperature defining a radially inwardly facing cam surface which surrounds said axis, an inlet cam plate having an axially inwardly facing inlet cam surface, and an outlet cam plate having an axially inwardly facing outlet cam surface which is opposed said axially inwardly facing inlet cam surface;

A pump having a fixed central member, a plurality of coplanar pistons which are coupled with said fixed central member, and a plurality of parallel spool valves which are coupled with said fixed central member and are perpendicular to said pistons and parallel to said axis;

said fixed central member being concentric with said axis and having an inlet port and an outlet port;

each said piston having a radially inner end and a radially outer end, radially outwardly extending from said fixed member, and slidably and reciprocatingly engaging said radially inwardly facing cam surface of said aperture of said rotor at said radially outer end of said piston;

each said spool valve having an inlet end and an outlet end, being located adjacent to said radially inner end of one said piston, communicating with said inlet port and said outlet port, and slidably and reciprocatingly engaging said axially inwardly facing inlet cam surface at said inlet end of said spool valve and said axially inwardly facing outlet cam surface at said outlet end of said spool valve;

said axially inwardly facing inlet cam surface having sinuosity with respect to the geometric plane defined by said pistons;

said axially inwardly facing outlet cam surface having sinuosity with respect to the geometric plane defined by said pistons which is complementary with respect to said sinuosity of said axially inwardly facing inlet cam surface;

whereby said engagements of said pistons with said radially inwardly facing cam surface of said aperture of said rotor coordinate with said engagements of said spool valves with said axially inwardly facing inlet cam surface and said axially inwardly facing outlet cam surface.

2. An integrated pumping mechanism as in claim 1 wherein said aperture of said rotor is elliptical and concentric with said axis.

3. An integrated pumping mechanism as in claim 1 wherein the speed of said pumping mechanism is varied by varying the speed of said electric motor.

4. An integrated pumping mechanism as in claim 1 wherein said pistons are located so as to provide balanced loadings on said rotor.

5. An integrated pumping mechanism as in claim 1 wherein said rotor includes a radially inner cam ring which is integral with said rotor and which has said aperture.

* * * * *